United States Patent [19]

Kunkel et al.

[11] Patent Number: 4,624,183

[45] Date of Patent: Nov. 25, 1986

[54] INK METERING DEVICE

[75] Inventors: Fred Kunkel; Peter Hummel, both of Offenbach am Main; Bert Cappel; Günther Schniggenfittig, both of Mühlheim; Helmut Kerber, Rödermark, all of Fed. Rep. of Germany

[73] Assignee: M.A.N.-Roland Druckmaschinen Aktiengesellschaft, Fed. Rep. of Germany

[21] Appl. No.: 760,304

[22] Filed: Jul. 29, 1985

[30] Foreign Application Priority Data

Jul. 28, 1984 [DE] Fed. Rep. of Germany ..... 3427909

[51] Int. Cl.[4] ..... B41F 31/04; B41L 27/06

[52] U.S. Cl. ..... 101/365

[58] Field of Search ..... 101/365, 350, 157, 169; 118/261; 15/256.5

[56] References Cited

U.S. PATENT DOCUMENTS 4,193,345 3/1980 Schoneberger ..... 101/365

4,328,748 5/1982 Schramm ..... 101/365

*Primary Examiner*—J. Reed Fisher

*Attorney, Agent, or Firm*—Leydig, Voit & Mayer

[57] ABSTRACT

An ink metering device for the fountain roller of a printing press including a plurality of ink slides in the ink fountain wherein each slide has a metering element of duct width movable by an adjusting screw which is connected to an adjusting pin and biased by a spring toward the fountain roller to produce a metering gap wherein the spring element is supported between a fixed part of the ink fountain and the metering element and a length-equalizing element is provided permitting transmission of an adjusting movement to the adjusting pin such that the lenth-equalizing action is effective only by overcoming the force of the spring element. In the preferred embodiment, the adjusting pin is rigid with the metering element and the other end is screwed into a length-equalizing coupling connected to a selective drive mechanism with the intermediate portion of the pin being supported for axial movement in a guide block.

15 Claims, 8 Drawing Figures

2
3
3
11
5
1.1
8
4.1
Y
6
9.1
10
1.2
7

INK METERING DEVICE

FIELD OF THE INVENTION

The present invention relates generally to an ink metering device consisting of ink slides in the ink fountain of a printing press, and more particularly concerns an arrangement wherein each ink slide has a metering element of duct width movable by an adjusting screw connected to an adjusting pin and biased by a spring element to produce a metering gap opposite an ink fountain roller.

BACKGROUND OF THE INVENTION

Metering elements in the form of ink slides are already known for adjustment of an ink film thickness profile on the ink fountain roller in the inking unit of offset printing presses. The ink film thickness is an indication of the quantity of ink required during printing, which is determined by the distribution of the printing areas on the printing plate. It represents relatively uniform ink supply over the width of the printing plate in contrast to the control possibilities over the width or length of ink strips with constant thickness. The ink film thickness used for metering corresponds to the smallest available dimension. Correspondingly narrow tolerances should be selected in the adjusting mechanism in the case of high accuracy requirements of the settings. In addition to a favorable, preferably linear adjustment characteristics, a high degree of reproducibility for the existing adjusting mechanisms is also required. Furthermore, the setting should not be affected by interruptions in the metering edge or displacement between metering elements and ink fountain roller. Effects of this type should be avoided, if possible.

Approximately continuous adjustment over the ink fountain width can be achieved with a continuous ductor blade. However, insoluble problems occur in the adjustment as a result of discontinuities in the event of extreme differences in ink consumption.

Use of the surface of the ink fountain roller as a reference area for adjustment of the individual metering elements in relation to this surface requires supports, which interrupt the metering areas and lead to non-uniform ink supply, wearing parts and complicated construction of the metering elements. Hence the use of linearly adjustable metering elements of duct width on an ink fountain guided in relation to the ink fountain roller remains. According to DE-OS No. 3,218,045 the ink fountain can be guided on both sides by cam rollers on the surface of the ink fountain roller. The position of the metering elements in relation to the ink fountain roller will thus be clearly fixed with a high degree of reliability. The metering elements themselves must be guided with minimum play to ensure adequate reproducibility.

A metering element of this type is described in U.S. Pat. No. 2,583,640. An ink fountain is provided with ductor blade sections corresponding to the width of an ink duct. The ductor blade sections are arranged on a bottom part of the ink fountain so as to be movable longitudinally and disposed with their metering edge adjacent the surface of an ink fountain roller. The direction of movement of the metering edge intersects the cross-section of the ink fountain roller essentially as a tangent. The ductor blade sections are provided with threaded holes in their rear end and in their longitudinal direction. The threaded ends of adjusting pins are screwed into these threaded holes. The adjusting pins are rotatable at the other end, but held immovably in the longitudinal direction and provided with a handle. The ductor blade sections are protected against penetrating ink by a cover plate in the area of the adjusting pins. The cover plate is pulled flexibly from below against the ductor blade sections and has a support at the rear end towards the bottom part of the ink fountain and a rear wall, through which the adjusting pins are guided. Helical springs, which force the play out of the screwed part of the adjusting pins into the ductor blade sections and their holder on the ink fountain, are arranged between the support and the ductor blade sections. The ink fountain roller is adjustable on the ink fountain.

The entire arrangement of the ductor blade sections, however, has significant disadvantages. It necessarily leads to large inaccuracies in the adjustment of the metering gap between the metering edge and the ink fountain roller. The ductor blade sections are flexible in the longitudinal direction and their long sides also lie close together. Apart from sealing problems, larger friction forces, which must be absorbed at least by the helical springs to compensate for play, can be anticipated in the case of adequately tight packing. The adjusting forces thus increase automatically or the adjustment is no longer reproducible. On the other hand sufficiently straight guidance of the ductor blade sections cannot be ensured despite this arrangement.

Furthermore, heavy wear will inevitably result when the metering edge contacts the ink fountain roller, because either the strong springs act on the metering edge or rigid support via the adjusting pins is achieved when the play is overcome. The expansions cannot be equalized under the effect of heat, because the metering gap is reduced at right angles to the direction of movement of the ductor blade sections. Highly accurate adjustment of the metering edge in relation to the ink fountain roller is important and indeed critical when only a small ink supply or very small ink film thickness is required. This is markedly affected by the above-mentioned shortcomings. The arrangement of the ductor blade sections near a tangent to the circumference of the ink fountain roller and the resulting wedge-shaped gap also permit build-up of a high dynamic pressure in the printing ink, which additionally affects the accuracy of adjustment of the metering gap.

OBJECTS AND SUMMARY OF THE INVENTION

The primary aim of the present invention is to create an ink metering arrangement, which can be adjusted accurately in relation to the ink fountain roller, the adjustability being readily reproducible and affected only slightly or not at all by heat or production inaccuracies as well as having low susceptibility to wear with the simplest adjustability.

Pursuant to the invention, an ink metering device for use with the fountain roller of a printing press is provided including a plurality of adjustable, spring-biased ink slides in the ink fountain. The guidance of the metering elements designed as slides in their longitudinal direction is ensured by connecting an adjusting pin firmly to each metering element and guiding it in its longitudinal direction in a guide block. The adjustment is made by turning a coupling on a screw at the free end of the adjusting pin. To ensure the reproducibility of the adjustment, a spring supported at one end by the metering element and at the other by the guide block is arranged on the adjusting pin. It loads the metering element in the direction of its metering edge and holds it supported in its adjusted position via the adjusting pin on the coupling.

The coupling is rigid with respect to torsion, but can be moved longitudinally. It permits movement of the metering element in relation to the drive connected rigidly to the guide block. Consequently thermal expansion and production inaccuracies do not result in stressing of the metering element between the ink fountain roller and a fixed part on the ink fountain. Excess wear or damage to the metering element, its metering edge and the drive mechanism can thus be precluded. This effect can be achieved by proper selection of the guide block and adjusting pin materials with regard to their thermal expansion characteristics in relation to the ink fountain and ink fountain roller. The thermal expansions can thus be caused to act in opposition to each other and partially offset one another.

An important advantage of the arrangement according to the present invention is that it is extremely easy to assemble and thus also maintain. Each metering element can be dismantled complete with its drive when the ink fountain is installed. The metering edge is also interchangeable. The metering element is adjusted by alignment of the guide block in its screwed part on the ink fountain and this can also be performed subsequently. Moreover, the metering elements can be readjusted via the drive mechanism itself in the event of wear on the metering edge. It is only necessary to provide a new reference point for an electrical control system. In particular, time-consuming work has been saved at this point.

These and other features and advantages of the invention will be more readily apparent upon reading the following description of a preferred exemplified embodiment of the invention and upon reference to the accompanying drawings wherein:

BRIEF DESCRIPTION OF THE INVENTION

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
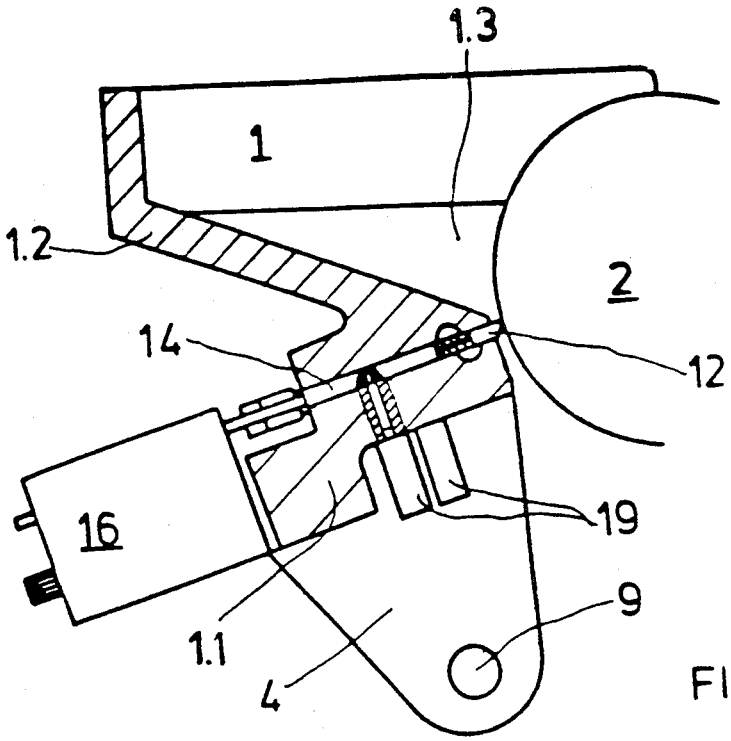
FIG. 1 shows an ink metering arrangement in a cross-section through a conventional ink fountain.

Turning now to the drawings, FIG. 1 shows the arrangement of an ink metering device in a conventional ink fountain. The ink fountain 1 consists of a bottom part 1.1, a top part 1.2 and side jaws 1.3. The ink fountain 1 is placed against an ink fountain roller 2. Supporting elements 4 mounted on a bearing shaft 9 are provided to hold the ink fountain 1. The entire ink fountain 1 can be swivelled about the bearing shaft 9 towards the ink fountain roller 2 by the fixed connection between the supporting elements 4 and bottom part 1.1 of the ink fountain and secured in this position by holding elements not shown here. Metering elements 12 are arranged between the bottom part 1.1 of the ink fountain and the top part 1.2. They are secured to the bottom part 1.1 of the ink fountain via guide blocks 14 with the aid of holding screws 19. Drives 16 for moving the metering elements 12 are also secured on the guide blocks 14 as will be described hereinafter. When the entire ink fountain 1 is swivelled the metering elements 12 are aligned with the ink fountain roller 2.

Figure 2:
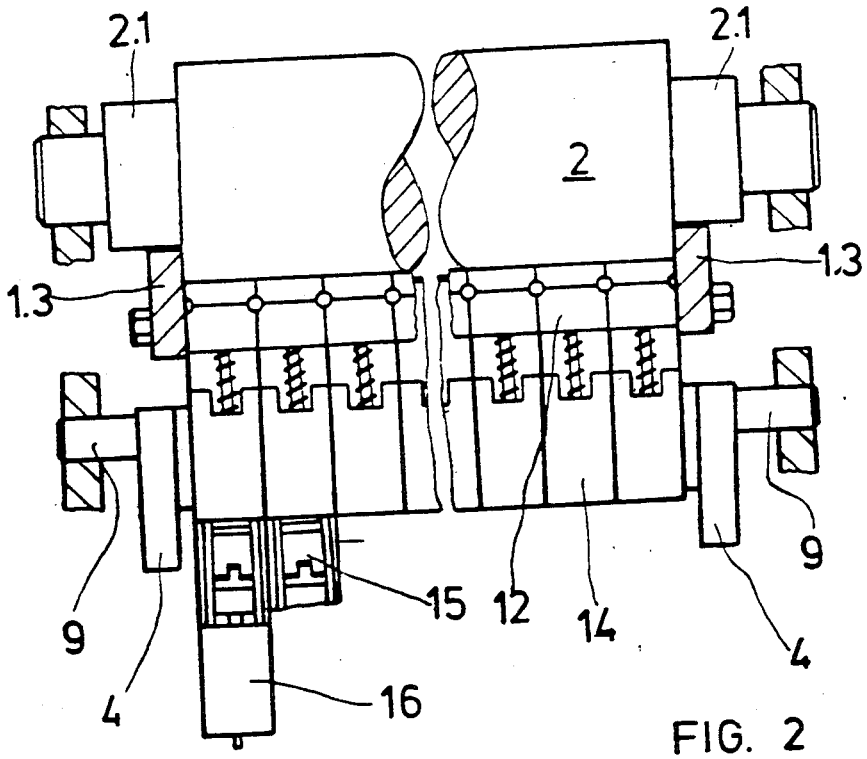
FIG. 2 is a plan view of FIG. 1.

FIG. 2 shows the arrangement of the metering elements 12 in the direction of the ink fountain roller 2. In particular the alignment of the ink fountain 1 on the ink fountain roller 2 can be seen here. The side jaws 1.3 of the ink fountain act as stops opposite the ink fountain roller 2. They rest against cylindrical bearing surfaces 2.1 on the journal of the ink fountain roller 2 and also seal the ink fountain 1 at the lateral limiting surface of the ink fountain roller 2. The metering elements 12 are packed close together.

Since the point where the ink fountain 1 swivels about the bearing shaft 9 is below the shaft of the ink fountain roller 2, accurate dimensioning of the supporting elements 4 and bearing surfaces 2.1 of the ink fountain 1 opposite the ink fountain roller 2 should be ensured. To mitigate the effect of production inaccuracies or simplify the production of the corresponding elements, the entire suspension of the ink fountain can be designed according to other principles. In particular, clamping the ink fountain completely rigidly in relation to the ink fountain roller, as in the example described above, should be avoided. Consequently, production inaccuracies and changes in dimensions during operation will be reflected in the constraining forces during operation. As a result of these forces, accurate adjustment of the ink metering may no longer be possible or the setting may change at random during operation. To overcome these difficulties, the ink fountain of the present invention has been provided with an improved decoupled holder arrangement.

Figure 3:
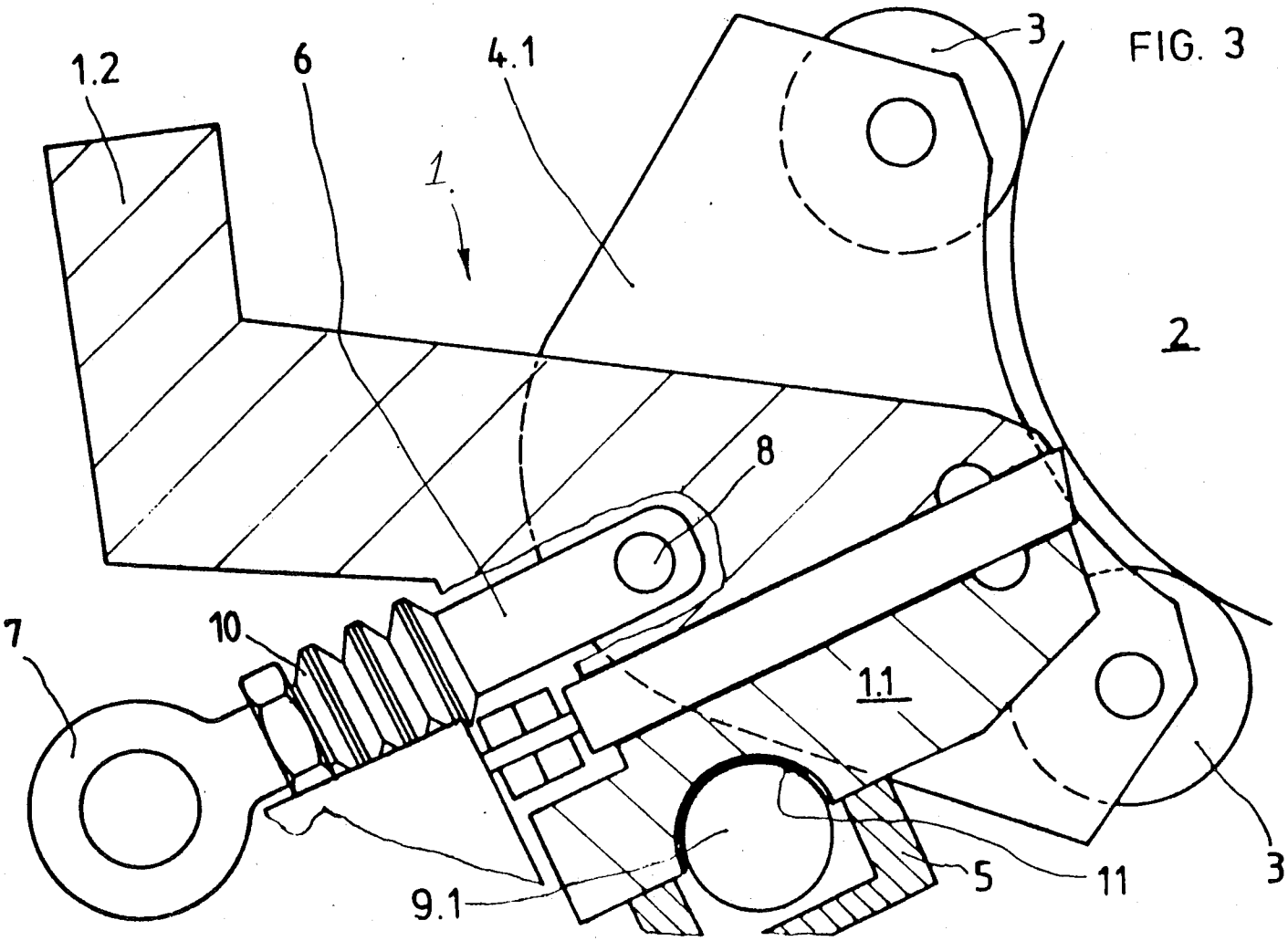
FIG. 3 is an enlarged, fragmentary sectional view of an ink metering arrangement in an ink fountain with support on the ink fountain roller.

The basic arrangement of the ink fountain 1 on the ink fountain roller 2 is shown in its preferred embodiment in FIG. 3. As shown here, a supporting element 4.1 is supported via two cam rollers 3 on the ink fountain roller 2. This arrangement is provided for both ends of the ink fountain roller 2. The ink fountain 1 is firmly connected at its bottom part 1.1 to the supporting elements 4.1 and is supported loosely by holders 5 on both sides. The holders 5 must have sufficient play so that the ink fountain 1 can follow the movement of the cam rollers 3 without constraining forces when supported via the supporting elements 4.1. Operative association of the ink fountain 1 with the ink fountain roller 2 is made possible by a lifting movement of the supporting elements 4.1.

This lifting movement is transmitted by coupling elements 6 from a swivelling gear (not shown here) acting on the eyelet 7 via bolt 8 to the ink fountain 1. The ink fountain 1 initially swivels about the bearing shaft 9.1 of the holder 5 until the lower cam roller 3 strikes the surface of the ink fountain roller 2. The ink fountain 1 is then lifted out on the holder 5 in the area of the above-mentioned play and raised with the lower cam roller 3 acting as pivot until the top cam roller 3 rests on the ink fountain roller 2. The fixed connection of the cam roller 3 via the supporting elements 4.1 to the ink fountain 1 then produces a defined correlation between the ink fountain 1 and ink fountain roller 2.

To ensure that the cam roller 3 always rests on the ink fountain roller 2 the swivelling gear must be prestressed, e.g., by operating via the dead center of the toggle lever in the case of a lever drive. In the example shown, the coupling element 6 is relieved in the longitudinal direction and provided with a set of cup springs 10, which permit overtravel of the swivelling gear in relation to the end position on the ink fountain roller 2. Equalization of movement between the ink fountain 1 and ink fountain roller 2 in the case of non-circularity or out-of-true running of the ink fountain roller 2 and the effects of heat on the entire arrangement is thus also made possible. For example, no constraining forces, which could affect the relative position between ink fountain 1 and the surface of ink fountain roller 2, can occur. It should be understood that the geometrical correlation of the bearing shaft 9.1 to the cam rollers 3 is not to scale and is somewhat schematically illustrated in the drawings.

The geometrical conditions at the holders 5 can, of course, also be selected in such a way that when the ink fountain 1 is placed against the ink fountain roller 2 the upper cam rollers 3 first rest against the fountain roller and the ink fountain 1 is fully applied from there. However, as shown in FIG. 3, the holder 5 must not be provided with a true semicylindrical bearing surface 11 in the ink fountain 1. Rather, to ensure an equalizing movement without constraining forces, the bearing surface 11 must be somewhat flat and elongated or at least slightly curved, so that a sliding movement of the bearing surfaces 11 on the bearing shaft 9.1 in the direction of the ink fountain roller 2 is possible.

Figure 4:
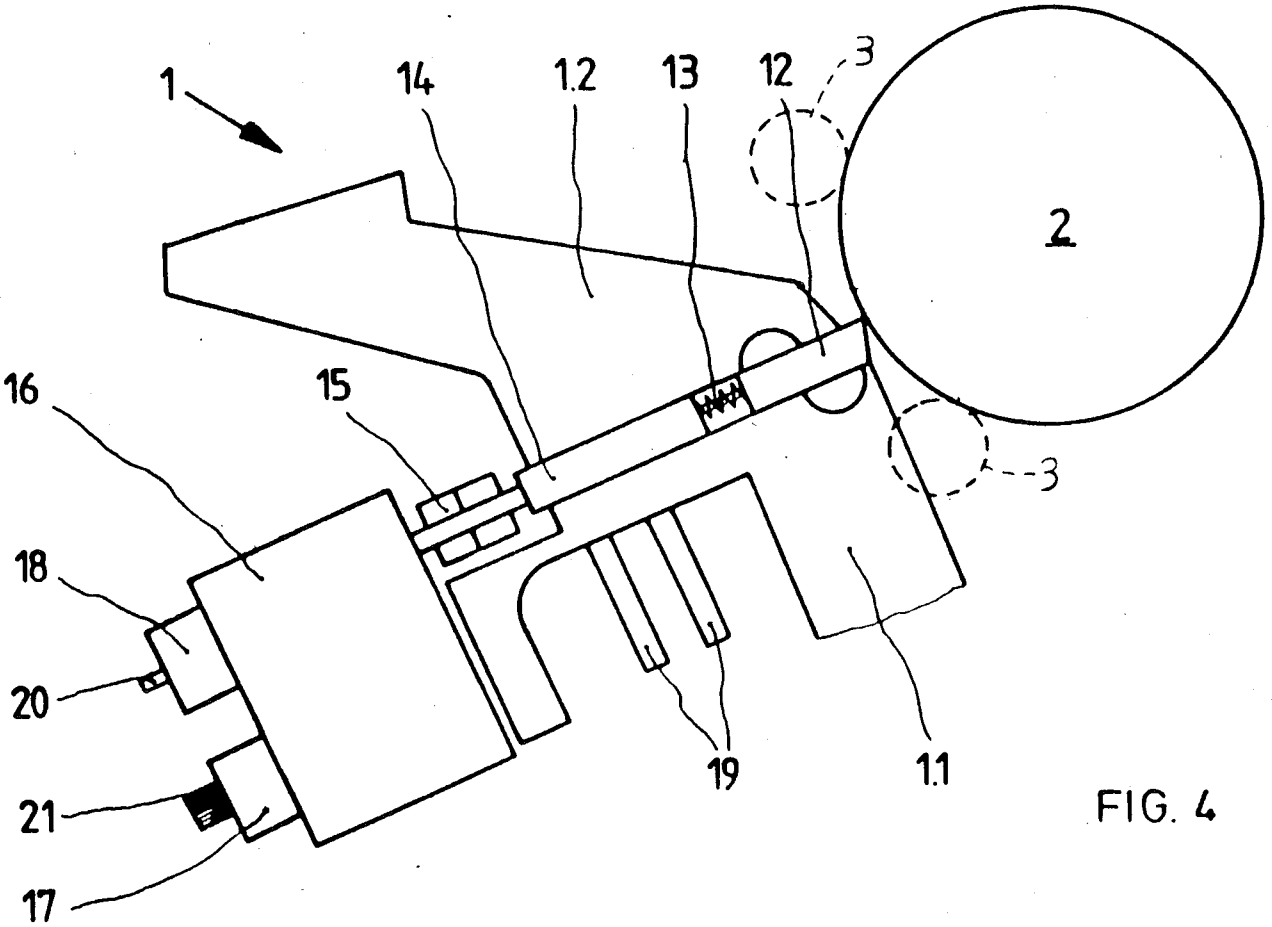
FIG. 4 is a schematic side view of an ink metering arrangement including the drive mechanism.

Referring now to FIG. 4, the arrangement of the ink metering device in relation to the ink fountain 1, as shown in FIG. 3 opposite the ink fountain roller 2 is shown in somewhat schematic form. With respect to the circumference of the ink fountain roller 2, the metering elements 12 are arranged in the arcuate space between the cam rollers 3 on the ink fountain 1. They rest on the bottom part 1.1 of the ink fountain and are aligned approximately radially with the ink fountain roller 2. The top part 1.2 of the ink fountain protects them against the penetration of printing ink.

The metering elements 12 are preferably guided by an adjusting pin 13 in a guide block 14. A coupling 15, which connects the adjusting pin 13 to a drive mechanism 16, is arranged on the rear end of the adjusting pin 13. The drive mechanism 16 contains a motor 17, a gear and a potentiometer 18. The potentiometer 18 is connected via a slip coupling, the motor 17 via the gear to the coupling 15 or the adjusting pin 13. The entire drive mechanism 16 is connected rigidly to the guide block 14 as will be described hereinafter, so that it forms a unit with the metering element 12 and all interposed parts. This unit is secured to the bottom part 1.1 of the inking unit by two holding screws 19 from the underside. The holding screws 19 are provided with an extended head to simplify operation during loosening and clamping. Fixing, assembly, dismantling and adjustment in the alignment in relation to the generatrix of the ink fountain roller 2 can be performed simply and with free access in this way.

The distance of the metering elements 12 from the surface of the ink fountain roller 2 is adjusted on the drive mechanism 16. For this purpose, the potentiometer 18 can be held from outside on a holding pin 20 and the motor 17 turned by a hand wheel 21. The gear turns with the coupling 15 in relation to the potentiometer 18, because a slip coupling permits rotation here. At the same time the metering element 12 is pushed by the adjusting pin 13. This process is required for adjusting the zero position of the individual metering elements 12 after wear.

Figure 5:
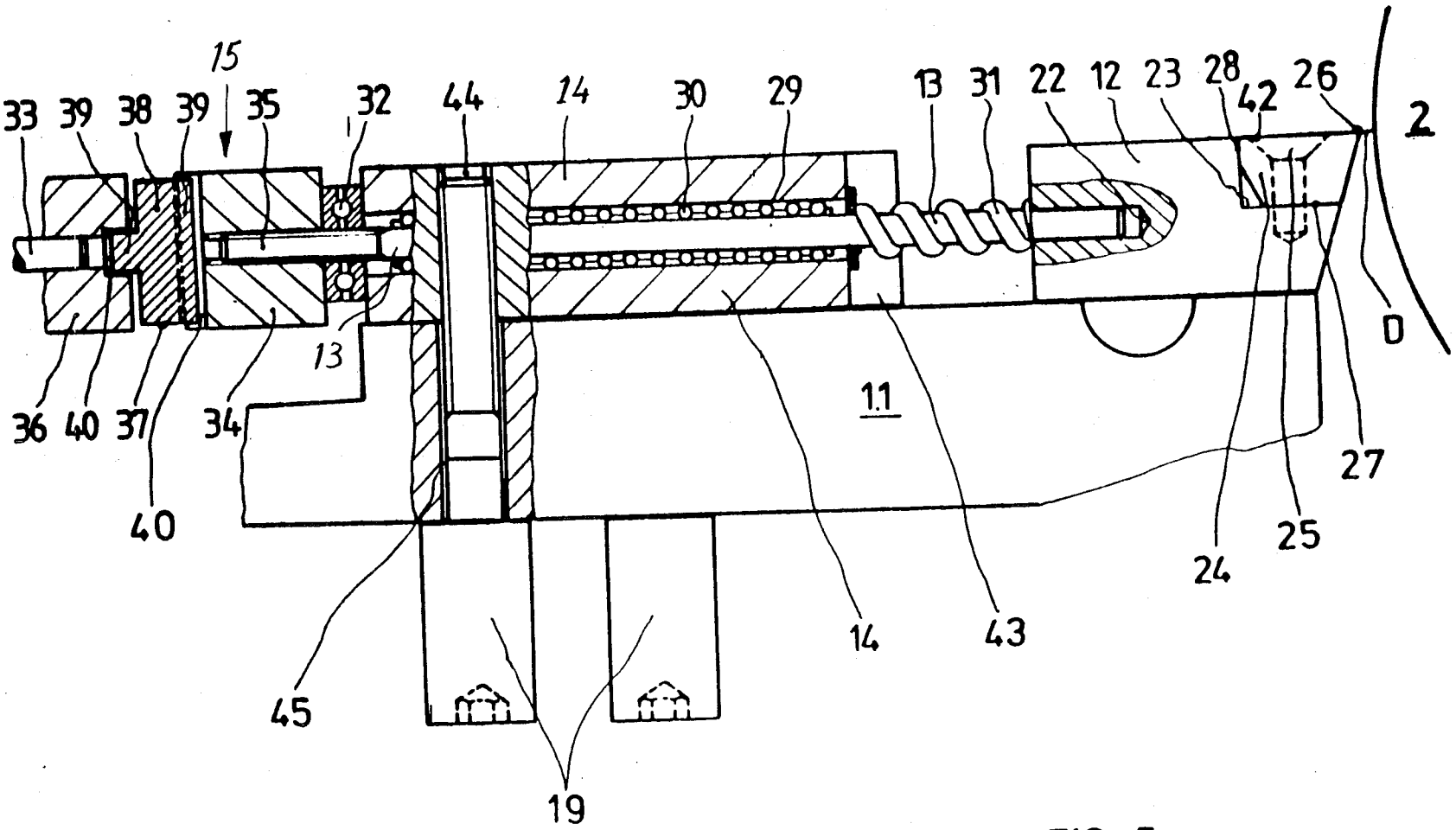
FIG. 5 is an enlarged fragmentary cross-section through the guide block, coupling and metering element of the preferred embodiment of the invention.

In FIG. 5, there is shown the construction of the metering elements 12, guide block 14 and coupling 15. The entire arrangement rests on the bottom part 1.1 of the ink fountain. The adjusting pin 13 is secured in a hole 22 of the metering element 12, e.g., by a press fit. The metering element 12 is provided with a shoulder 23 on its upper front side. A slide tip 24 is secured by two clamping screws 25 on this shoulder 23. The front edge of the slide tip 24 is the metering edge 26 of the metering element 12 and it forms the reference edge for production of a defined ink film thickness on the ink fountain roller 2. The position of the slide tip 24 on the metering element 12 is ensured by complementary fitting areas. For this purpose the bearing surfaces 27, 28 between metering element 12 and slide tip 24 are machined with very close tolerance. This is advantageous in particular for subsequent maintenance and replacement work. In addition, the rear support surface 28 is slightly stepped to provide a defined position for the slide tip 24 when it is first installed and subsequently when the tip is changed after wear.

The position of the metering element 12 is ensured by the control and guidance of the adjusting pin 13 in the guide block 14. The guide block 14 is provided with a longitudinal hole 29, into which a longitudinal guide in the form of an axial ball bearing 30 is inserted. The longitudinal hole 29, ball bearing 30 and adjusting pin 13 are toleranced in such a way that the adjusting pin 13 can be moved axially without radial play in relation to the guide block 14. The length of the ball bearing 30 also ensures that no inadmissibly large deformations (e.g., bending) can occur in the adjusting pin 13 under load.

The holding screws 19 are screwed into the guide block 14 through holes 45 in the bottom part 1.1 of the ink fountain and clamp it on its top side as reference surface. In the preferred embodiment, the metering element 12 should still remain easily movable. A compression spring 31 is arranged on the adjusting pin 13 between the guide block 14 and metering element 12. The coupling 15 is supported via an axial bearing 32 on the guide block 14 on the opposite side.

The coupling 15 is divided to permit absorption of movements and tolerances in the drive assembly. It separates or connects the adjusting pin 13 to the drive shaft 33 from the gear. The coupling half 15 facing the metering element 12 is screwed as screw coupling 34 on a threaded end 35 of the adjusting pin 13. The other coupling half is secured as clamping coupling 36 on the drive shaft 33. The two coupling halves 34, 36 are connected to each other in the form of an Oldham type coupling. For this purpose a coupling disc 37 is used between the screw coupling 34 and clamping coupling 36. The coupling disc 37 consists of a cylindrical central part 38 and two tongues 39 offset at 90° to each other on each end of the central part 38 and the tongues 38, 39 engage in corresponding slots 40 on the coupling halves 34, 36.

Since the drive shaft 33 is fixed in its position in relation to the guide block 14 and thus also in relation to the coupling 15, the loose connection of the two coupling halves 34, 36 is secured by the clamping of the clamping coupling 36 on the drive shaft 33. Because the two tongues of the coupling disc 37 are at right angles to each other, the coupling disc 37 cannot fall out and the drive assembly is uncoupled axially and radially by the coupling disc 37. The purpose of this arrangement, of course, is to avoid radial or axial constraining forces in the drive assembly and to permit corresponding movements.

It will be understood that the adjusting pin 13 and thus the metering element 12 is moved in the axial direction of the adjusting pin 13 by rotation of the screw coupling 34 on the threaded end 35. Preferably, the screw coupling 34 is initially screwed on far enough so the compression spring 31 is compressed and a defined state of equilibrium of the specified elements among each other is provided. In this condition, the screw coupling 34 rests against the axial bearing 32, which absorbs the reaction force of the compression spring 31 on the guide block 14. At the same time the play is removed from the screwed part of the screw coupling 34 on the threaded end 35 by the stressing of the compression spring 31. The spring force is fixed at a predetermined amount of stressing and hardly changes in the range of adjustment of the metering elements 12.

Figure 6:
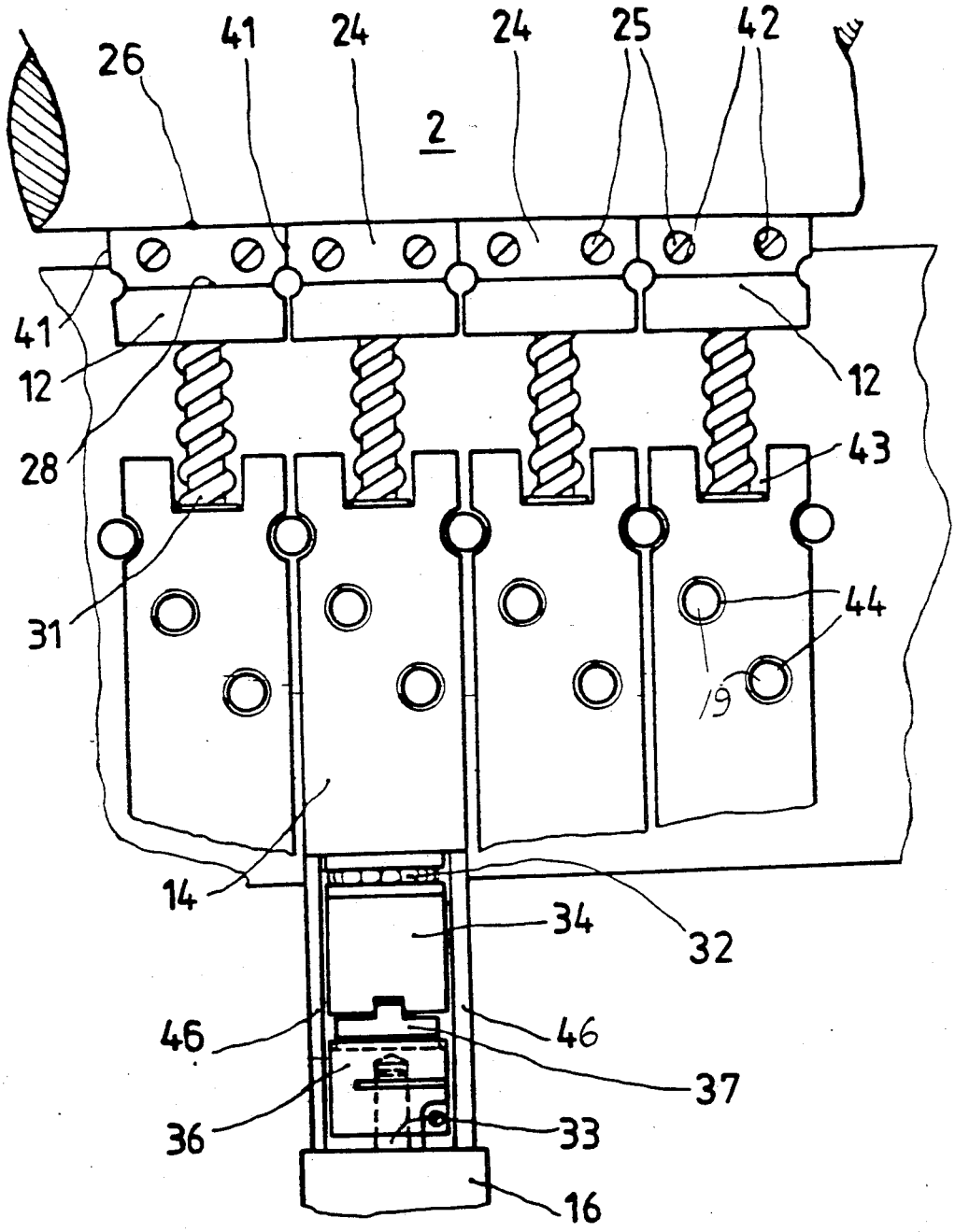
FIG. 6 is a fragmentary horizontal section showing the arrangement of the metering elements in operating position with respect to the ink fountain roller.

Turning now to FIG. 6, the position of the metering elements 12 next to each other in the axial direction with respect to the ink fountain roller 2 is shown. The arrangement is preferably selected so that the slide tips 24 touch each other along their front side edges 41. Otherwise the side edges 41 are ground slightly conically towards the rear, so that excessively large friction surfaces do not impede the movability of the tips. The screw holes 42 for fixing the slide tips 24 with the clamping screws 25 on the metering element are desirably sealed with a sealant resistant to printing ink after clamping.

Proper positioning of the metering edge 26 with respect to the alignment of the metering elements 12 is ensured via highly accurate observance of the parallelism between the metering edge 26 and bearing surface 28. To permit use of the longest possible and thus also relatively weak compression spring 31, the guide block 14 is provided with a recess 43, the base of which supports the compression spring 31, in the area of the longitudinal hole 29. Two threaded holes 44 vertical to the longitudinal hole 29 and diagonally opposite each other, which correspond to holes 45 in the bottom part 1.1 of the ink fountain and receive the holding screws 19, are provided in the guide block 14. The holes 45 provide for slight play in relation to the holding screws 19 in order to permit adjustment of the guide block 14.

In the preferred embodiment, two cross bars 46 are connected to each of the guide blocks 14 and form a rigid, fixed length connection between guide block 14 and drive mechanism 16. This arrangement permits dismantling of individual units including the drive mechanism 16, guide block 14, adjusting pin 13 and metering element 12. Only the holding screws 19 have to be loosened for this purpose; the specified unit can then be withdrawn from the ink fountain 1. Slide tips 24 can be changed conveniently and without dismantling the top part 1.2 of the ink fountain. The unit also need not be dismantled into its individual components. The unit is installed in the same way. However, the unit must now be aligned with the ink fountain roller 2. A coarse tolerance of the holding screws 19 in the holes 45 in the bottom part 1.1 of the ink fountain is provided and this is desirable because it can never be ensured that all parts fit each other exactly. However, the metering edges 26 should be as parallel as possible with the generatrix of the ink fountain roller 2 to prevent so-called "edge support", i.e., contact between one end of the metering edge 26 and the ink fountain roller 2, whereas an ink film passes through at the other end. The unit can be aligned by applying a small quantity of printing ink and observing the film distribution during adjustment of the metering elements 12. As already described, the distance between the metering edge 26 and ink fountain roller 2 can be adjusted via the drive 16 itself.

The operating principle of the entire arrangement will be explained below. When the drive 16 is rotated either by a motor 17 as in the example or by hand, which is likewise possible with hand wheel 21, the clamping coupling 36 is rotated by its drive shaft 33. It takes along the coupling disc 37 via its slot 40 and a tongue 39 and the screw coupling 34 via the other tongue 39 and the second slot 40. As the adjusting pin 13 is rigidly secured in the metering element 12, the coupling must rotate on the threaded end 35 and thus move the adjusting pin 13, metering element 12 and slide tip 24 together. The metering gap D is thus adjusted.

If the metering gap D is to be opened, the screw coupling 34 must be screwed on to the threaded end 35, i.e., the adjusting pin 13 pulled away from the ink fountain roller 2. The compression spring 31 is thus also compressed. When the metering gap D is closed the screw coupling 34 is screwed outwardly on the threaded end 35 and the compression spring 31 presses the metering element 12 as it expands towards the ink fountain roller. It is important that no constraining forces occur in the area of contact between metering edge 26 and ink fountain roller 2. In this case the slide tip 24 would very quickly become unserviceable as a result of damage to the metering edge 26. Even the surface of the ink fountain roller 2 would be destroyed in the worst case. Such constraints may occur, if a metering gap D smaller than the non-circularity or eccentricity rotating with the ink fountain roller 2 or smaller than possible thermal expansions is to be adjusted. Constraints may also occur in the event of a so-called zero ink film, i.e., interruption of the ink supply, by exceeding the actual zero position.

In the arrangement of the present invention the constraining force is limited to a low maximum value from the outset. This limitation results from the fact that the metering element 12 or adjusting pin 13 on the threaded journal 35 is released in the axial direction when the metering edge 26 contacts the ink fountain roller 2. When the screw coupling 34 is turned back further it is lifted from the axial bearing 32 and releases the latter. The metering element 12 is now held between the metering edge 26 and the ink fountain roller 2 on one side and the compression spring 31 and the guide block 14 on the other.

The force occurring at the metering edge 26 is defined from the outset; it corresponds to the initial tension of the compression spring 31. Greater forces are not possible, because axial play is provided in the coupling 15. The play can be freely selected by adjusting the distance between the coupling halves 34, 36 at the clamping coupling 36 on the drive shaft 33. Only the length of the tongues 39 on the coupling disc need be noted. The screw coupling 34 can then be turned further via the release position when the ink fountain roller 2 contacts the slide tip 24 until the coupling 15 rests on the block in the area of the selected play. However, the range of rotation for such wide adjustment is so great that mechanical limitation easily provides a remedy. If the screw coupling 34 has lifted off the axial bearing 31, the metering element 12 is movable under the force of the compression spring 32 in relation to the surface of the ink fountain roller 2. Hence it can follow non-circularities, eccentricities or thermal expansions without any change in the force at the point of contact. A large safety margin for the serviceability of the specified arrangement is thus created precisely in the range of very small ink film thicknesses.

The effect of the mutual influencing of the metering elements 12 via sag of the ink fountain roller 2 is likewise eliminated, because the ink fountain roller 2 can no longer be stressed at random by radial loads. The position and magnitude of the forces acting on the ink fountain roller 2 can be checked at any time. Limitation of the forces in the area of the ink metering to a few points and in a controllable magnitude is the prerequisite for to accurate adjustment and good reproducibility of the control of metering gap D.

Figure 7A:
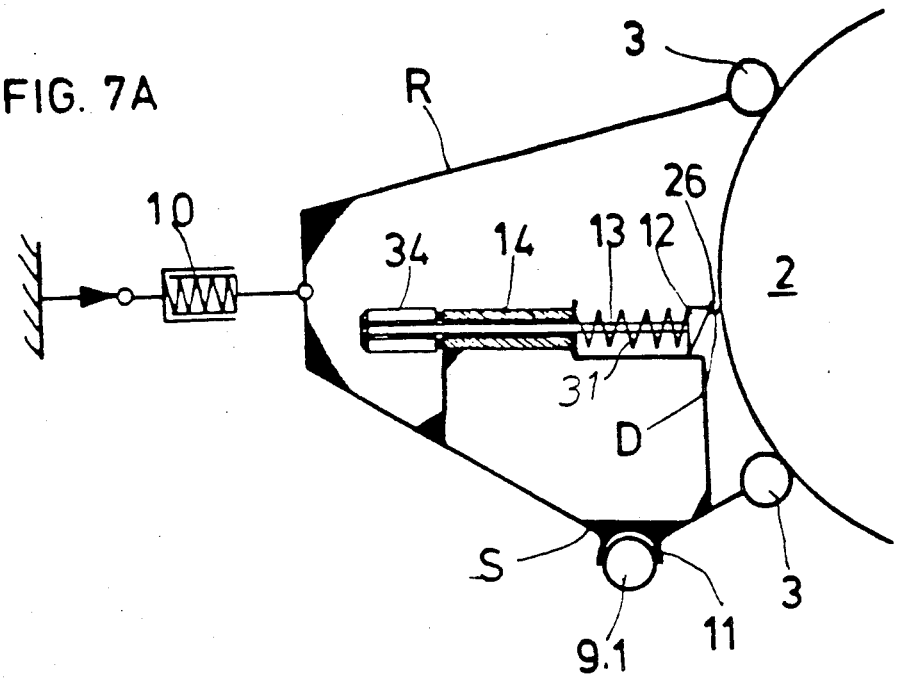
FIGS. 7 A and B are schematic diagrammatic illustrations of the basic layout of an arrangement according to FIG. 3, shown as partial transverse and horizontal sections, respectively.
Figure 7B:
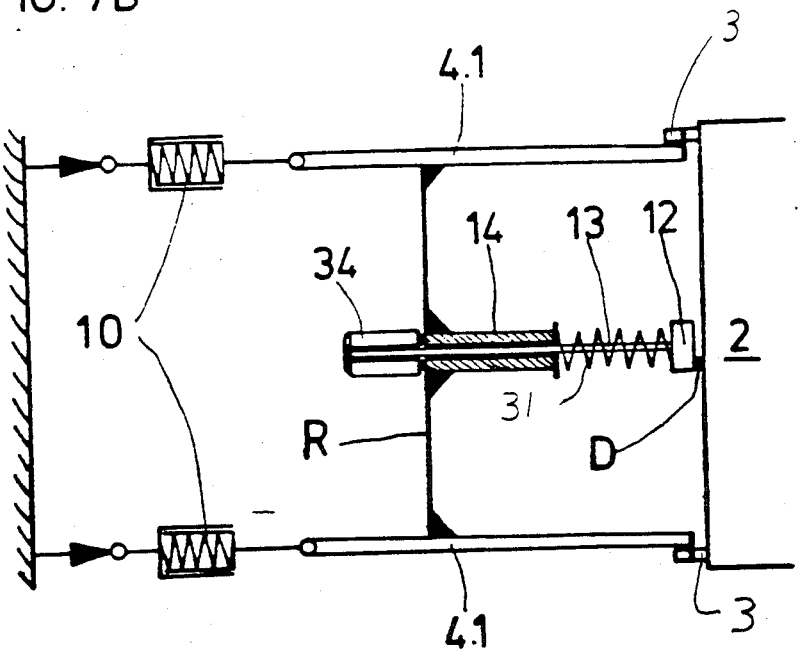

FIG. 7A and 7B show in simplified schematic form the basic arrangement of the elements within the ink fountain 1 with an ink metering device according to the present invention. FIG. 7A shows the arrangement of the ink fountain 1 in cross-section viewed in the direction of the axis of the ink fountain roller 2. The ink fountain 1 is shown with its supporting element opposite the ink fountain roller 2 as rigid frame R. It is supported by the surface of the ink fountain roller 2 via the cam rollers 3. The application force is produced by the set of springs 10, which is loaded by a lever drive in relation to the machine frame. The frame R of the ink fountain is supported on the bearing shaft 9.1, where it is provided with a swivelling bearing S. The ink fountain 1, which carries the guide of metering elements 12, is mounted rigidly on the frame R. An adjusting pin 13 is mounted within the guide block 14 for this purpose. The metering element 12 is secured to the adjusting pin 13 and is moved by a screw coupling 34. The defined position of the metering element 12 is ensured by the compression spring 31. The metering gap D results from the adjustment of the screw coupling 34 on the adjusting pin 13. The position of the metering edge 26 on the metering element 12 is determined by the support of the frame R via the cam rollers 3 on the surface of the ink fountain roller 2. If non-circularities or other production defects occur on the ink fountain roller 2, these will not adversely affect the adjustment of the metering element 12, because the entire system can follow these defects. It is thus ensured that the metering gap D is largely independent of production inaccuracies.

In FIG. 7B the arrangement of the ink fountain 1 is shown diagrammatically in a longitudinal section through the ink fountain 1. The frame R is connected rigidly to the supporting elements 4.1, which are supported via the cam rollers 3 on the ink fountain roller 2. The force for supporting the cam rollers 3 is generated by the set of springs 10. The guide block 14 is rigidly mounted on the frame R, which in reality corresponds to the bottom part 1.1 of the ink fountain. As described the metering element 12 is guided on the adjusting pin 13 by the compression spring 31. It safeguards the dimensioning of the metering gap D. The right-angled position of the metering element 12 in relation to the surface of the ink fountain roller 2 is secured by the arrangement of the guide block 14 and clamping of the adjusting pin 13 within the guide block 14. The metering element 12 is forced by the spring in the direction of the ink fountain roller 2, where it is secured in its position by the screw coupling 34, because the latter rests against the frame R or the guide block 14 and can be freely moved in the opposite direction by surmounting the force of the compression spring 31.

The guidance of the metering edge 26 on the metering element 12 in relation to the ink fountain roller 2 is ensured by the frame R as described above and at the same time permits equalization of the thermal expansions within the entire system. If the supporting elements 4.1 expand under the effects of heat, the metering edge 26 would have to be moved away from the ink fountain roller 2 by the rigid connection. However, the adjusting pin 13 will likewise be extended by the heat transfer within the system and compensate for the movement from the supporting elements 4.1. If the diameter of the ink fountain roller 2 is changed by the effects of heat, the entire system, i.e., also the metering element 12 with the surface of the ink fountain roller 2, is moved away. However, the distance of the metering edge 26 from the surface of the ink fountain roller 2 does not change.

Guidance of the entire arrangement by cam rollers 3 on the surface of the ink fountain roller 2 can now be described in more detail. If the entire system on the frame R on the bearing shaft 9.1 is swung away from the ink fountain roller 2, the set of springs 10 is relieved and the top cam roller 3 will be furthest from the ink fountain roller 2, whereas the bottom cam roller 3 is still approximately in contact with the ink fountain roller 2. When the system is placed against the ink fountain roller 2 the set of springs 10 is loaded with a force, which initially lifts only the system, so that the lower cam roller 3 comes into contact with the ink fountain roller 2. The system is then lifted further with an increase in the force at the set of springs 10 until the upper cam roller 3 also rests against the ink fountain roller 2. Only then is the force in the set of springs 10 increased until reliable contact of the cam rollers 3 on the ink fountain roller 2 is ensured. The metering element 12 can then also be adjusted in a defined position in relation to the ink fountain roller 2 by the adjusting pin 13.

We claim as our invention:

1. An ink metering device including a plurality of ink slides in the ink fountain of a printing press wherein the ink fountain is placed opposite the ink fountain roller, each ink slide having a metering element of duct width movable by an adjusting screw which is connected to an adjusting pin and biased by a spring element relative to the ink fountain to produce a metering gap opposite the ink fountain roller, each adjusting pin being mounted on the ink fountain without radial play but freely movable in the direction of its longitudinal axis, the spring element being supported between a fixed part on the ink fountain and the metering element, and a length-equalizing coupling permitting transmission of an adjusting movement to the adjusting pin and the metering element arranged so that its length-equalizing action is effective only by overcoming the force of the spring element.

2. An ink metering device according to claim 1, wherein the adjusting pin is rigidly secured at one end to the metering element and is guided in a ball bearing within a guide block screwed to the bottom part of the ink fountain, the other end of the adjusting pin is formed with a threaded screw on which the length-equalizing coupling connected to a drive shaft of a drive mechanism is mounted, the drive mechanism and guide block being rigidly connected, and the spring element is a helical compression spring arranged on the adjusting pin between the metering element and the guide block so that the adjusting pin is supported on the guide block via the length-equalizing coupling.

3. An ink metering device according to claim 2, wherein the length-equalizing coupling comprises an Oldham coupling, one-half of the coupling being arranged as a screw coupling on the threaded screw end of the adjusting pin and the other half as a clamping coupling rigidly connected to the drive shaft on the drive mechanism and each of the coupling halves having slots into which tongues on an intermediate coupling disc are engageable.

4. An ink metering device according to claim 3, wherein the tongues and slots of the coupling each have axial dimensions predetermined by the maximum adjustment range of the metering element and corresponding at least to the pitch of the adjusting thread on the threaded screw.

5. An ink metering device according to claim 2, wherein an axial bearing is provided between the screw coupling and the guide block and the screw coupling is supported thereon under the force of the compression spring.

6. An ink metering device according to claim 1, wherein the metering element is provided with a metering edge on an interchangeable slide tip which is secured by clamping screws against bearing surfaces on the metering element, the bearing surfaces and the metering edge being in a fixed geometrical relationship to each other.

7. An ink metering device according to claim 1, wherein the ink fountain is supported via cam rollers on the surface of the ink fountain roller and the metering elements act in the arcuate space between the supporting points of the cam rollers.

8. An ink metering device according to claim 7, including mounting elements interconnecting the ink fountain and the cam rollers and wherein the mounting elements and the metering elements consist of materials with substantially identical thermal expansion characteristics.

9. An ink metering device according to claim 8, wherein at least the adjusting pin consists of a material with thermal expansion characteristics corresponding to that of the material of the mounting elements.

10. An ink metering device according to claim 1, wherein the adjusting pin is connected to a drive mechanism via the length-equalizing coupling and the spring element is connected to the metering element in such a way that the metering element is forced by the spring element against a shoulder on the adjusting pin and play is provided for the shoulder in a recess in the metering element in the axial direction with respect to the adjusting pin.

11. An ink metering device according to claim 10, wherein the play between the shoulder on the adjusting pin and the recess in the metering element at least corresponds to the pitch of the thread on the threaded screw and preferably corresponds to the maximum adjustment range of the metering edge.

12. An ink metering device according to claim 2, wherein the metering element is provided with a metering edge on an interchangeable slide tip which is secured by clamping screws against bearing surfaces on the metering element, the bearing surfaces and the metering edge being in a fixed geometrical relationship to each other.

13. An ink metering device according to claim 2, wherein the ink fountain is supported via cam rollers on the surface of the ink fountain roller and the metering elements act in the arcuate space between the supporting points of the cam rollers.

14. An ink metering device according to claim 13, including mounting elements interconnecting the ink fountain and the cam rollers and wherein at least the adjusting pin consists of a material with thermal expansion characteristics corresponding to that of the material of the mounting elements.

15. An ink metering device according to claim 2, wherein the adjusting pin is connected to a drive mechanism via the length-equalizing coupling and the compression spring element is connected to the metering element in such a way that the metering element is forced by the compression spring against a shoulder on the adjusting pin and play is provided for the shoulder in a recess in the metering element in the axial direction with respect to the adjusting pin.

* * * * *